US011109159B2

(12) United States Patent
Shen et al.

(10) Patent No.: US 11,109,159 B2
(45) Date of Patent: Aug. 31, 2021

(54) SPEAKER BOX

(71) Applicant: AAC Technologies Pte. Ltd., Singapore (SG)

(72) Inventors: Kaihua Shen, Shenzhen (CN); Jun Wu, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,798

(22) Filed: Dec. 8, 2019

(65) Prior Publication Data

US 2020/0213741 A1 Jul. 2, 2020

(30) Foreign Application Priority Data

Dec. 30, 2018 (CN) ..... 201811649104.X

(51) Int. Cl.
*H04R 7/16* (2006.01)
*H04R 9/06* (2006.01)
*H04R 1/02* (2006.01)

(52) U.S. Cl.
CPC ..... *H04R 7/16* (2013.01); *H04R 1/025* (2013.01); *H04R 9/06* (2013.01)

(58) Field of Classification Search
CPC ..... H04R 7/16; H04R 9/06; H04R 1/025; H04R 1/2873; H04R 1/021; H04R 1/345; H04R 7/04; H04R 2499/11
See application file for complete search history.

(56) References Cited

U.S. PATENT DOCUMENTS

2004/0017919 A1* 1/2004 Miyakura ..... H04R 1/2842 381/71.6
2013/0070951 A1* 3/2013 Tanaka ..... H04R 1/38 381/361

(Continued)

FOREIGN PATENT DOCUMENTS

CN 107318073 A1 11/2017
CN 108462929 A1 8/2018
CN 109874067 A1 6/2019

OTHER PUBLICATIONS

1st Office Action dated Nov. 4, 2019 by SIPO in related Chinese Patent Application No. 201811649104.X (6 Pages).

(Continued)

*Primary Examiner* — Tuan D Nguyen
(74) *Attorney, Agent, or Firm* — W&G Law Group LLP

(57) ABSTRACT

A speaker box includes an upper shell and a lower shell that define a receiving space, and a speaker unit received in the receiving space and dividing the receiving space into front and rear cavities. The speaker unit includes a diaphragm spaced apart from the upper shell to form a front acoustic cavity. The upper shell is formed with a sound transmitting channel communicating the front acoustic cavity with the outside. The upper shell includes a top wall, and a support wall extending from the top wall towards the lower shell. The speaker box further includes a partition wall extending from the top wall towards the lower shell, and a cover plate extending from the partition wall towards the support wall. The partition wall, the cover plate and the support wall define at least two resonant cavities spaced apart from each other and in communication with the front cavity.

10 Claims, 6 Drawing Sheets

(56) References Cited

U.S. PATENT DOCUMENTS

| | | | | |
|---|---|---|---|---|
| 2013/0129133 | A1* | 5/2013 | Inoda | H04R 1/08<br>381/337 |
| 2016/0261949 | A1* | 9/2016 | Liu | H04R 1/2826 |
| 2018/0184209 | A1* | 6/2018 | Zhu | H04R 9/06 |

OTHER PUBLICATIONS

PCT search report dated Jan. 15, 2020 by SIPO in related PCT Patent Application No. PCT/CN2019/110732 (4 Pages).

* cited by examiner

SPEAKER BOX

TECHNICAL FIELD

The present invention relates to the technical field of electroacoustic conversion, and particularly, to a speaker box.

BACKGROUND

In recent years, with the rapid development of mobile communication technologies, consumers are increasingly using mobile communication devices having a voice function, such as portable phones, handheld game consoles, laptop computers and the like. When the speaker box is used as a voice playing device, the design thereof directly affects voice performance of mobile communication devices. In order to meet the market demand for thinning and high tone quality, higher requirements are raised on the design of the speaker box.

In the related art, a speaker box includes an upper shell, a lower shell and a speaker unit. The speaker unit includes a diaphragm. The diaphragm and the upper shell are spaced apart to define a front acoustic cavity. A sound transmitting channel is molded with a side wall of the upper shell. The front acoustic cavity and the sound transmitting channel constitute a front cavity. Such a structure may generate a resonance peak at a high frequency response. With popularity of stereo application of the mobile terminal, the higher frequency response of the speaker is no longer pursued. Moreover, the excessively high frequency response (especially 4000-6000 Hz) may cause problems of non-ideal tone quality such as a harsh sound and a sharp labiodental.

Therefore, it is urgent to provide a new speaker box to solve the above drawbacks.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

Figure 1:
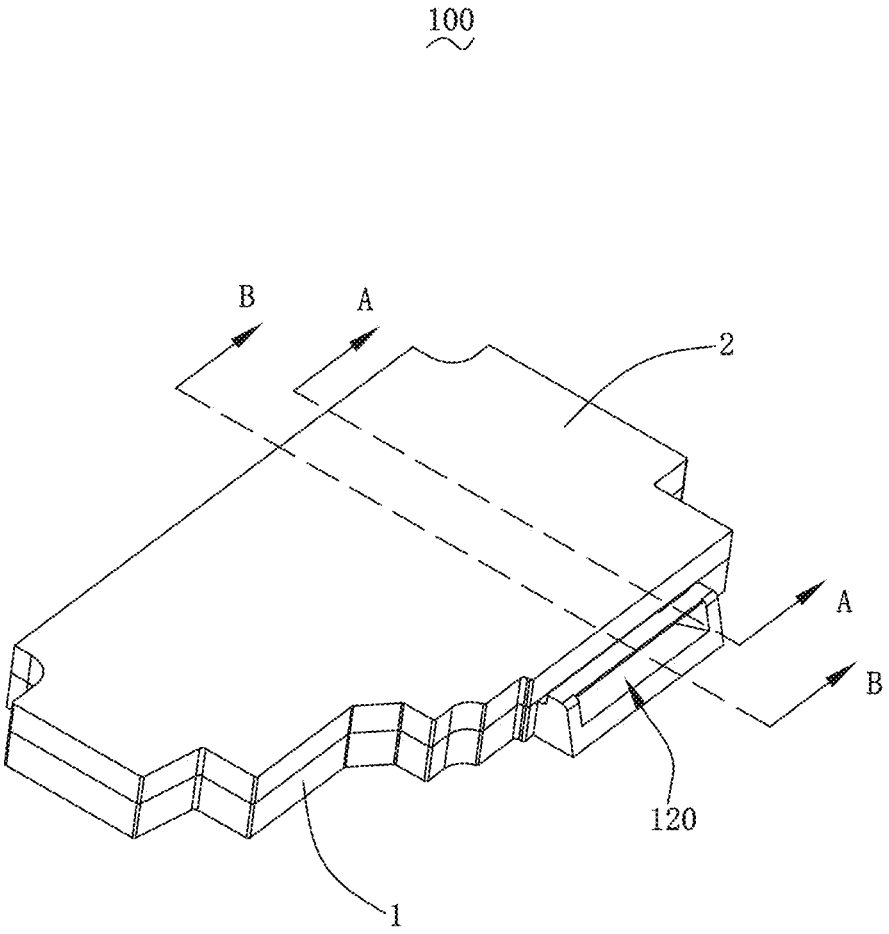
FIG. 1 is a perspective structural view of a speaker box according to an embodiment of the present invention.
Figure 2:
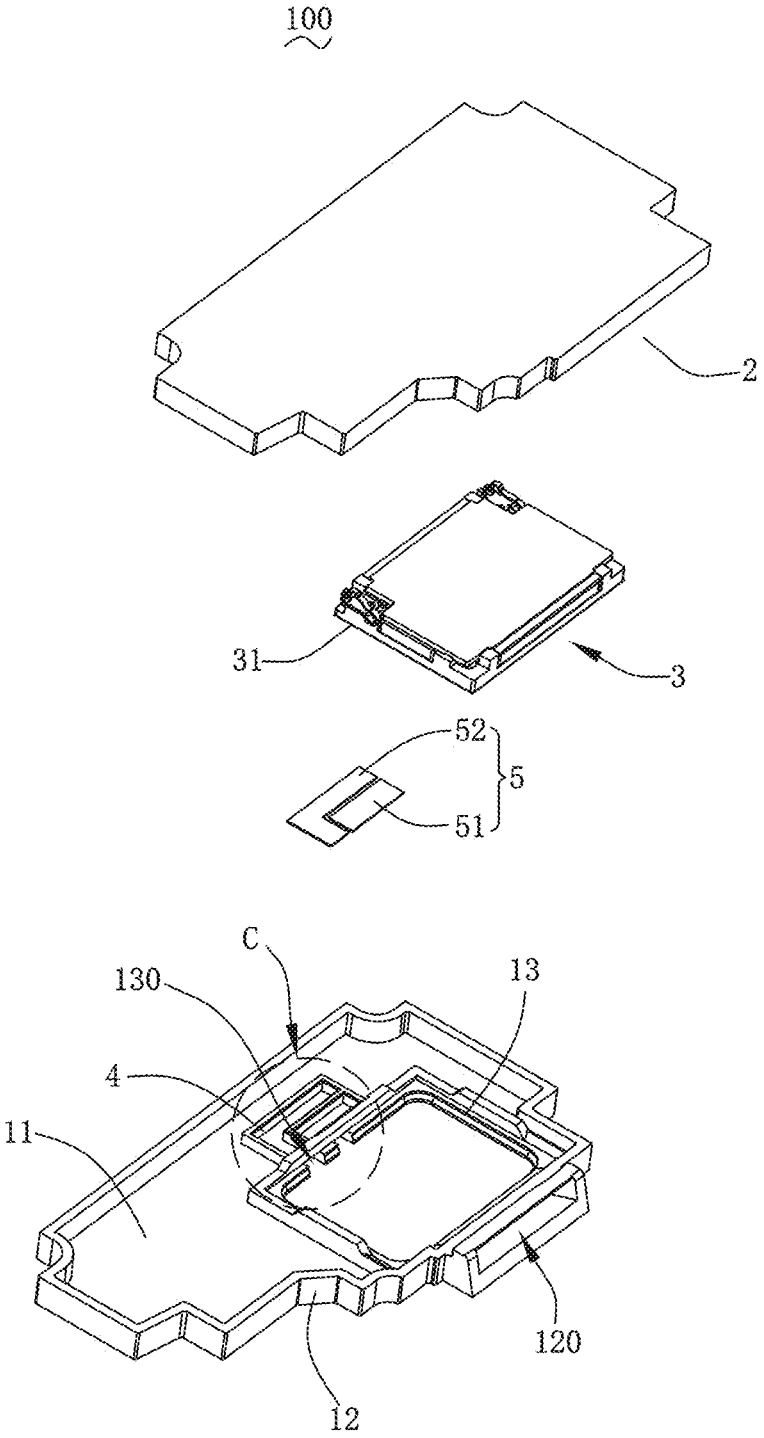
FIG. 2 is an exploded structural view of the speaker box shown in FIG. 1.
Figure 3:
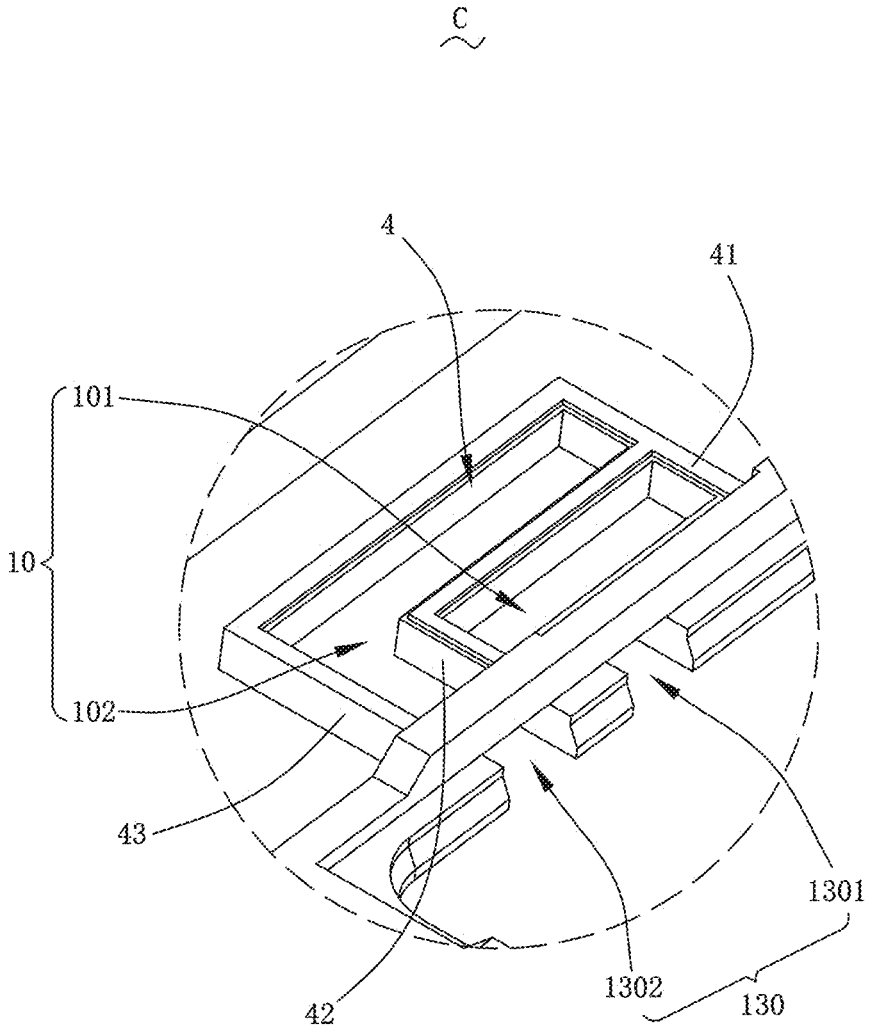
FIG. 3 is an enlarged view of a region C shown in FIG. 2.
Figure 4:
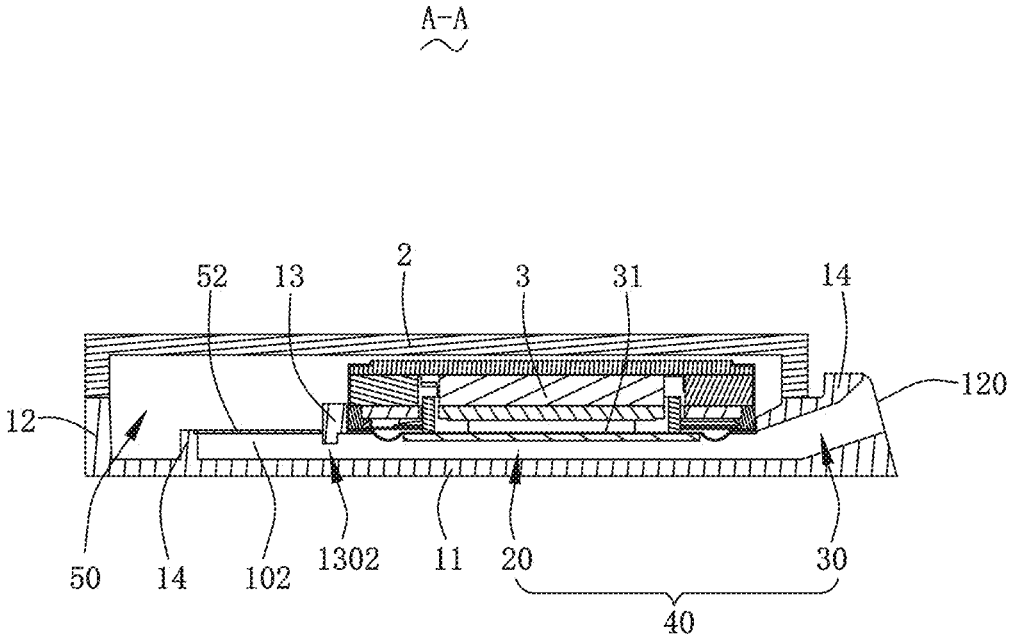
FIG. 4 is a cross-sectional view of the speaker box taken along line A-A shown in FIG. 1.
Figure 5:
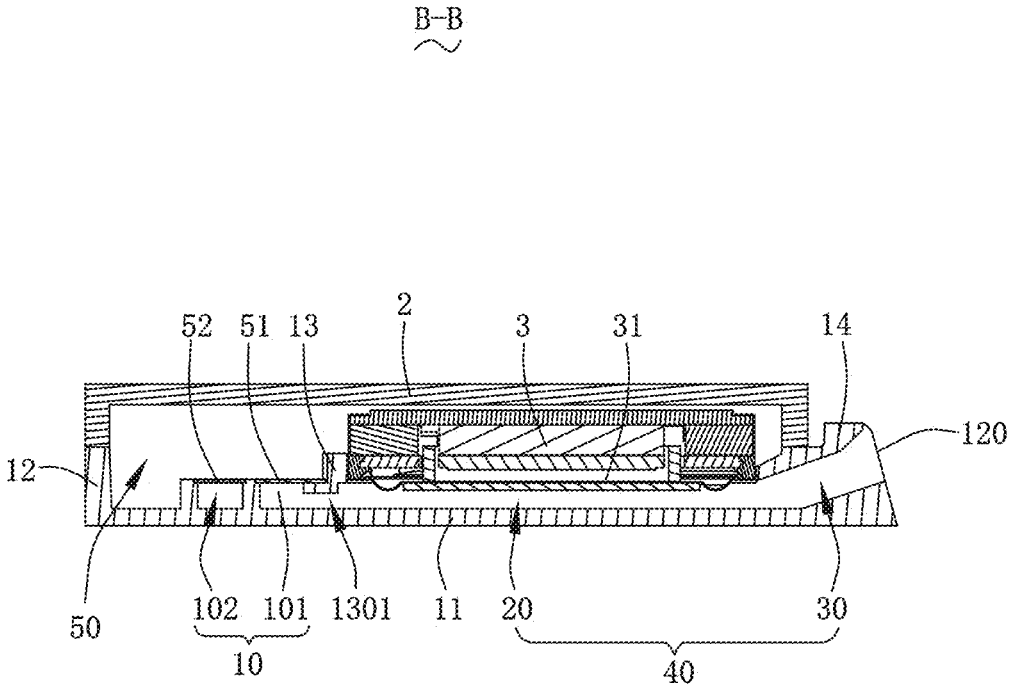
FIG. 5 is a cross-sectional view of the speaker box taken along line B-B shown in FIG. 1.

The above described embodiments are merely intended to illustrate the present invention, and it should be noted that, without departing from the inventive concept of the present invention, the improvements made by those skilled in the related art shall fall within the protection scope of the present invention.

As shown in FIG. 1 to FIG. 5, the present invention provides a speaker box 100. The speaker box 100 includes an upper shell 1, a lower shell 2, a speaker unit 3 having a diaphragm 31, a partition wall 4, a cover plate 5, a resonant cavity 10, a front acoustic cavity 20, a sound transmitting channel 30, a front cavity 40, and a rear cavity 50.

The upper shell 1 is configured to support and protect the speaker unit 3. The lower shell 2 covers the upper shell 1 and defines a receiving space together with the upper shell 1. The speaker unit 3 is received in the receiving space which is divided into the front cavity 40 and the rear cavity 50 by the speaker unit 3. The diaphragm 31 is configured to vibrate and emit sound. The upper shell 1 and the diaphragm 31 are spaced apart to define the front acoustic cavity 20. The upper shell 1, the speaker unit 3 and the lower shell 2 together define the rear cavity 50.

The partition wall 4 is formed by extending from a top wall 11 towards the lower shell 2. The cover plate 5 extends from the partition wall 4 towards a support wall 13. The partition wall 4, the cover plate 5 and the support wall 13 define at least two resonant cavities 10 spaced apart from each other, and the resonant cavities 10 are in communication with the front cavity 40.

The upper shell 1 includes a top wall 11, a side wall 12 and a support wall 13. The top wall 11 faces right the diaphragm 31. The side wall 12 extends from the top wall 11 towards the lower shell 2 and is fixed to the lower shell 2. The support wall 13 extends from the top wall 11 towards the lower shell 2 and is fixed to the support wall 13 of the speaker unit 3. The support wall 13 surrounds an outer circumference of the speaker unit 3.

The sounding channel 30 is formed at the upper shell 1 and communicates the front acoustic cavity 20 with the outside. The front acoustic cavity 20 and the sounding channel 30 together define the front cavity 40 for transmitting sound to the outside.

Further, the side wall 12 is provided with a sound transmitting hole 120 at a position corresponding to the sounding channel 30. The upper shell 1 further includes a baffle 14. One end of the baffle 14 abuts against the speaker unit 3, and the other end of the baffle 14 extends to the sound transmitting hole 120. The sound transmitting channel 30 is formed between the baffle 14 and the top wall 11. The resonant cavity 10 and the sound transmitting channel 30 are arranged at two opposite sides of the speaker unit 3.

The support wall 13, corresponding to the resonant cavity 10, is provided with a through-hole 130 communicating the resonant cavity 10 with the front cavity 40. The resonant cavity 10 communicates with the front cavity 10 only via the through-hole 130.

In this embodiment, two resonant cavities 10 are provided. In other embodiments, other number of the resonant cavities 10 may be provided. The resonant cavity 10 includes a first resonant cavity 101 and a second resonant cavity 102 that are spaced apart from each other. The partition wall 4 includes a first blocking wall 41, a second blocking wall 42, and a third blocking wall 43. The first blocking wall 41 extends from a side of the supporting wall 13 facing away from the sound transmitting channel 30 towards the interior of the rear cavity 50. The second blocking wall 42 and the third blocking wall 43 extend from an end of the first blocking wall 41 facing away from the support wall 13 towards the support wall 13, respectively. The first blocking wall 41 and the third blocking wall 43 are located at two opposite sides of the second blocking wall 42.

The first resonant cavity 101 is formed between the first blocking wall 41 and the second blocking wall 42. The second resonant cavity 102 is formed between the third blocking wall 43 and the first blocking wall 41.

Further, the through-hole 130 and the resonant cavity 10 are provided is in one-to-one correspondence. The through-hole 130 includes a first through-hole 1301 in communication with the first resonant cavity 101, and a second through-hole 1302 in communication with the second resonant cavity 102. A size of the first through-hole 1301 is smaller than or equal to a width of an end of the first resonant cavity 101 close to the support wall 13. A size of the second through-hole 1302 is smaller than or equal to a width of an end of the second resonant cavity 102 close to the support wall 13.

The cover plate 5 includes a first steel sheet 51 and a second steel sheet 52. The first steel sheet 51 covers the first blocking wall 41 and the second blocking wall 42. The second steel sheet 52 covers the first blocking wall 41 and the third blocking wall 43. The first steel sheet 51 and the second steel sheet 52 are each ultrasonically sealed from the partition wall 4 and the support wall 13. The first steel sheet 51 and the second steel sheet 52 are each in a thin sheet shape. The first steel sheet 51 and the first resonant cavity 101 match in shape. The second steel sheet 52 and the first resonant cavity 101 match in shape. The cover plate 5 is a plastic cover plate, a PET cover plate, or a steel sheet.

Figure 6:
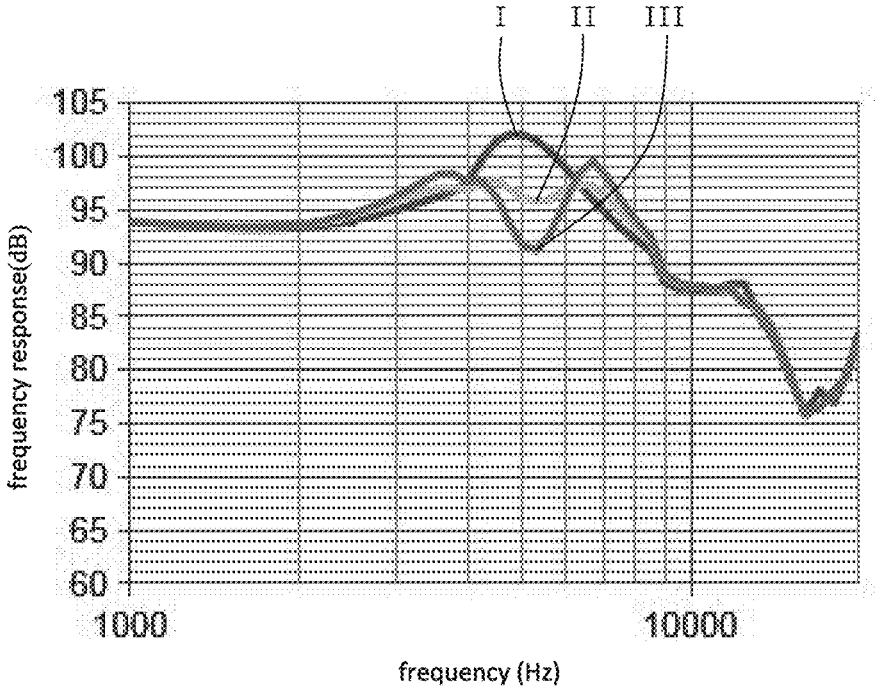
FIG. 6 is frequency response graphs of a speaker box in the related art and a speaker box provided by the present invention.

Based on the Helmholtz resonance principle, the first resonant cavity 10 and the second resonant cavity 20 can form anti-resonance at a resonance peak position of the front cavity 40 per se, so that a flatness of a high frequency response of the speaker box 100 can be improved, and resonant amplification effect of noise of the front cavity 40 can also be effectively reduced, thereby effectively improving the acoustic performance of the speaker box 100. As shown in FIG. 6, curve I is a frequency response graph of a speaker known in the related art; curve II is a frequency response graph of a speaker box having a first resonant cavity and a second resonant cavity that have one size provided by the present invention; and curve III is a frequency response graph of a speaker box having a first resonant cavity and a second resonant cavity that have another size provided by the present invention. Is can be seen from FIG. 6 that the frequency responses of the speaker boxes provided by the present invention are significantly reduced in a frequency range of 4000-6000 Hz.

By adjusting the size and shape of the partition wall 4, the sizes of the first resonant cavity 101 and the second resonant cavity 102 can be changed, so that the resonance peak value can be effectively lowered, thereby achieving the optimal sounding effect.

Compared with the related art, in the speaker box 100 provided by the present invention, by providing the first resonant cavity 101 and the second resonant cavity 102 that are in communication with the front cavity 40, the high frequency resonance peak and sensitivity can be effectively reduced; meanwhile, the partition wall 4 defining the first resonant cavity 101 and the second resonant cavity 102 is received in the receiving space of the speaker box 100 and is located at a side of the supporting wall 13 without occupying the space in height of the speaker box 100, so that the requirements for thinning and lighting design of the speaker box 100 can be achieved.

The above described embodiments are merely intended to illustrate the present invention, and it should be noted that, without departing from the inventive concept of the present invention, the improvements made by those skilled in the related art shall fall within the protection scope of the present invention.

What is claimed is:

1. A speaker box, comprising:

an upper shell;

a lower shell defining a receiving space with the upper shell;

a speaker unit received in the receiving space;

a partition wall; and a cover plate, wherein the speaker unit divides the receiving space into a front cavity and a rear cavity, and comprises a diaphragm configured to vibrate and emit sound, the diaphragm is spaced apart from the upper shell to define a front acoustic cavity, the upper shell is provided with a sound transmitting channel communicating the front acoustic cavity with outside, the front acoustic cavity and the sound transmitting channel together form the front cavity of the speaker box, wherein the upper shell comprises a top wall facing right the diaphragm, a side wall extending from the top wall towards the lower shell and fixed to the lower shell, and a support wall extending from the top wall towards the lower shell to the rear cavity and fixing the speaker unit, the top wall, the side wall, and the lower shell define the receiving space, the support wall surrounds an outer circumference of the speaker unit, the partition wall extends from the top wall towards the lower shell to the rear cavity, and the cover plate extends from the partition wall towards the support wall, the partition wall, the cover plate, and the support wall are received in the receiving space, the cover plate is received in the receiving space and is spaced from the speaker unit;

the partition wall, the cover plate, and the support wall defines at least two resonant cavities spaced apart from each other, the at least two resonant cavities are in communication with the front cavity.

2. The speaker box as described in claim 1, wherein the support wall, corresponding to the at least two resonant cavities, is provided with at least two through-holes communicating the at least two resonant cavities with the front cavity, and each of the at least two resonant cavities is in communication with the front cavity only via a corresponding through-hole of the at least two through-holes.

3. The speaker box as described in claim 2 wherein the at least two resonant cavities and the sound transmitting channel are arranged at two opposite sides of the speaker unit.

4. The speaker box as described in claim 3, wherein the at least two resonant cavities cavity comprise a first resonant cavity and a second resonant cavity that are spaced apart from each other, the partitioning wall comprises a first blocking wall, a second blocking wall, and a third blocking wall, the first blocking wall extending from a side of the supporting wall facing away from the sound transmitting channel towards an interior of the rear cavity, the second blocking wall and the third blocking wall extending from an end of the first blocking wall facing away from the support wall towards the support wall, the first resonant cavity is formed between the first blocking wall and the second blocking wall, and the second resonant cavity is formed between the third blocking wall and the first blocking wall.

5. The speaker box as described in claim 4, wherein the first blocking wall and the third blocking wall are located at two sides of the second blocking wall, respectively.

6. The speaker box as described in claim 4, wherein the cover plate comprises a first steel sheet covering the first blocking wall and the second blocking wall, and a second steel sheet covering the first blocking wall and the third blocking wall.

7. The speaker box as described in claim 6, wherein the first steel sheet and the second steel sheet are each ultrasonically sealed from the partition wall and the support wall.

8. The speaker box as described in claim 6, wherein a shape of the first steel sheet matches a shape of the first resonant cavity, a shape of the second steel sheet matches a shape of the first resonant cavity, and both the shape of the first steel sheet and the shape of the second steel sheet are thin sheet shapes.

9. The speaker box as described in claim 8, wherein the at least two through-holes and the at least two resonant cavities are provided in one-to-one correspondence, and the at least two through-holes comprise a first through-hole in communication with the first resonant cavity, and a second through-hole in communication with the second resonant cavity, a size of the first through-hole is smaller than or equal to a width of an end of the first resonant cavity close to the support wall, and a size of the second through-hole is smaller than or equal to a width of an end of the second resonant cavity close to the support wall.

10. The speaker box as described in claim 6, wherein the upper shell further comprises a baffle, the side wall is provided with a sound transmitting hole at a position corresponding to the sound transmitting channel, one end of the baffle abuts against the speaker unit, and the other end of the baffle extends to the sound transmitting hole, the sound transmitting channel is formed between the baffle and the top wall.

* * * * *